United States Patent [19]

Jantunen

[11] 3,937,591

[45] Feb. 10, 1976

[54] CONTROLLING A SLUDGE FLOW

[75] Inventor: Vilho Viljo Jantunen, Pyhakumpu, Finland

[73] Assignee: Outokumpu Oy, Outokumpu, Finland

[22] Filed: Nov. 2, 1973

[21] Appl. No.: 412,166

[30] Foreign Application Priority Data

Nov. 6, 1972 Finland ..... 3089/72

[52] U.S. Cl. ..... 415/157; 415/1; 137/625.3; 210/197

[51] Int. Cl.[2] ..... F04D 15/00

[58] Field of Search ..... 415/1, 17, 36, 146, 147, 415/148, 157, 158; 137/625.3, 625.38; 210/197; 417/900

[56] References Cited

UNITED STATES PATENTS

| | | | |
|---|---|---|---|
| 1,123,927 | 1/1915 | Rotter | 415/36 |
| 1,484,983 | 2/1924 | Britcher | 415/158 |
| 1,520,668 | 12/1924 | Wilkin | 415/36 |
| 1,555,851 | 10/1925 | Van Emon | 137/625.3 |
| 1,786,166 | 12/1930 | Moody | 415/148 |
| 2,355,458 | 8/1944 | Mastenbrook | 137/625.38 |
| 2,355,564 | 8/1944 | Sebald | 210/197 |
| 2,404,701 | 7/1946 | Felsecker | 210/197 |
| 3,186,939 | 6/1965 | Murray | 210/197 |
| 3,601,511 | 8/1971 | Massenbach | 417/900 |
| 3,625,628 | 12/1971 | Byrns | 415/147 |
| 3,672,786 | 6/1972 | Mount | 415/147 |
| 3,752,188 | 8/1973 | Sage | 137/625.3 |
| 3,788,478 | 1/1974 | Savage | 210/197 |

FOREIGN PATENTS OR APPLICATIONS

| | | | |
|---|---|---|---|
| 445,697 | 4/1939 | United Kingdom | 210/197 |
| 766,266 | 6/1934 | France | 415/157 |
| 750,764 | 7/1933 | France | 417/900 |

*Primary Examiner*—C. J. Husar
*Attorney, Agent, or Firm*—Brooks Haidt Haffner & Delahunty

[57] ABSTRACT

The invention relates to a method for controlling a pumped sludge flow by throttling the suction side of the pump and to a device for use in the method. The device having an inner member with an outer member so fitted around it that the inner member and the outer member can be moved in relation to each other, and inlets provided in either the inner member or the outer member or both so that when the inner member or the outer member is in one extreme position the inlets are fully closed and when it is in the other extreme position the inlets are fully closed, and a channel which leads to the suction side of the pump fixed to either the inner member or the outer member so that when the inlets are open, liquid flows from the surroundings through the inlets into the channel and thence into the pump.

4 Claims, 4 Drawing Figures

CONTROLLING A SLUDGE FLOW

BACKGROUND OF THE INVENTION

1. Field of the Invention

The invention relates to the field of controlling sludge flows pumped with a pump and to valves used for throttling such sludge flows.

2. Description of the Prior Art

The variation of rate of flow of a fluid through a pump can be necessary or desirable for a number of reasons, for example: the data upon which the design of an installation is based may not be in accordance with the actual process conditions encountered in operation; an installation may not be operated at full capacity; the required rate of discharge for production may require variation in the flow rate; and the pump may be set up for changing conditions, as for example in a pilot or experimental plant. The pump must then be adapted to fit the changed conditions and the flow rate must be controlled. These facts are well recognized in the art. See, for example, G. Leuschner, *Kleines Pumpenhandbuch fuer Chemie und Technik*, pp. 77 – 79 (1967).

Pump control has usually taken place either by changing the number of revolutions of the pump or by throttling the flow on the pressure side of the pump by means of a valve. When sludge flows are concerned, pumps are also often used without any control.

Regulating the number of revolutions of a pump without steps is absolutely the best control method, but a very expensive one. This high cost is noted at p. 79, line 22 of the aforementioned Leuschner handbook. Controlling the flow rate of a pump by throttling the pressure side is a method almost inapplicable to sludge pumps for the following reasons:

No control valves on the market endure high sludge flow rates. The life of the tube of a tube valve, which is often used, may be only 3–4 days. The pressure of the box water should be 0.5 kp/cm² above the pressure on the pressure side. The great pressure impulses caused by a control valve placed on the pressure side prevent a continuous flow of the box water and the sludge may flow over through the box against the bearing bracket, thereby causing the box structure to wear out prematurely and shortening the life of the bearings.

SUMMARY OF THE INVENTION

According to the invention throttling of pumped sludge flows is now effected on the suction side of the pump. Heretofore controlling a pump on the suction side has not been considered possible because of an obvious risk of cavitation and other disturbances caused to the pumpage. This has been recognized in the literature. (Leuschner, op.cit. p. 78). It was unexpected to find that sludge flows can be controlled by throttling the suction side of the pump without any such risks.

The method according to the invention can be used because, when sludge is pumped, cavitation does not appear to such an extent as when clean water is pumped, which is due to the solid material content in the device and possibly also to the fact that the sludge is always to some extent in a frothing state. Mechanical wear and tear in a sludge pump is also more considerable than cavitation erosion.

DESCRIPTION OF THE PREFERRED EMBODIMENTS

Figure 1:
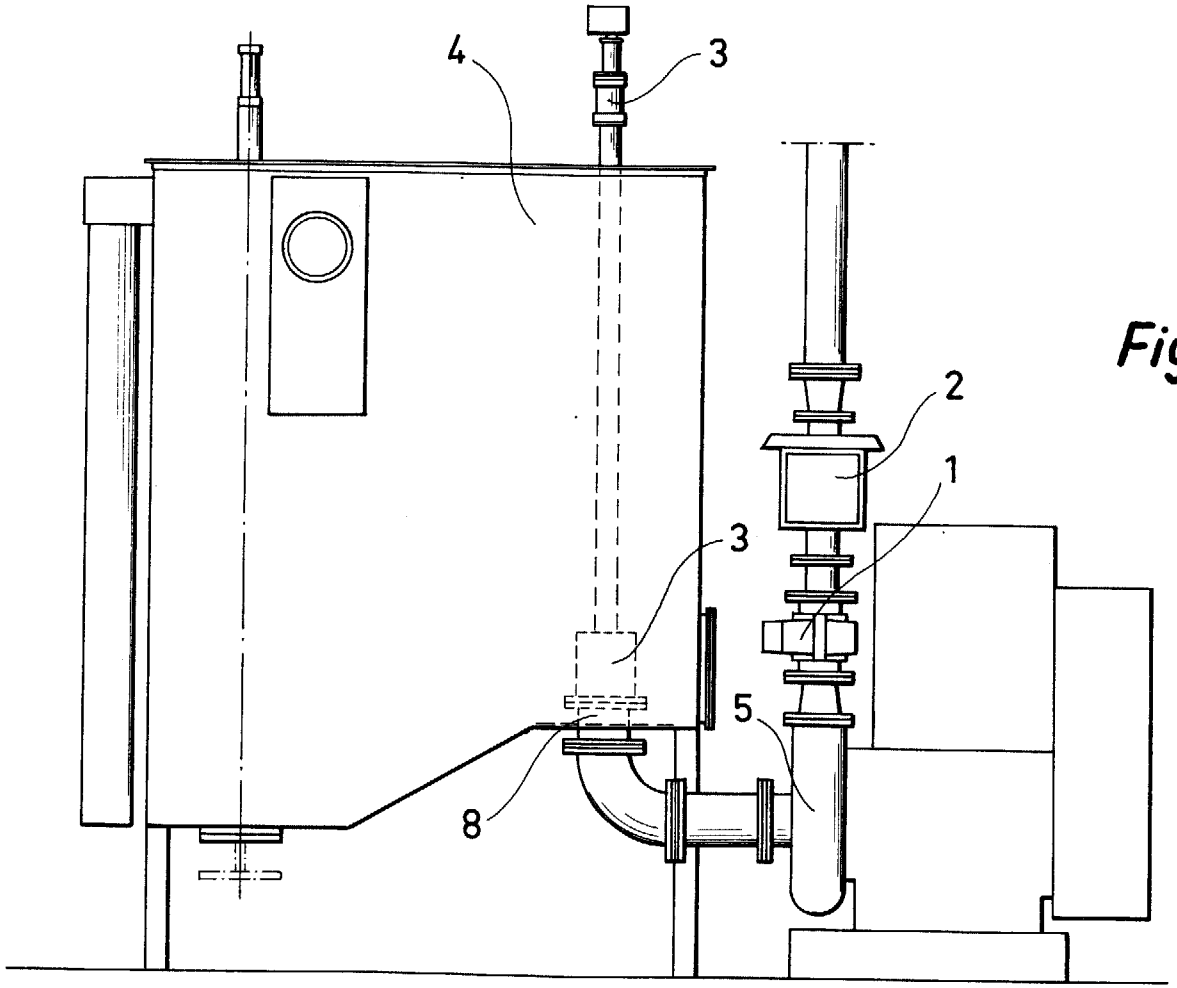
FIG. 1 shows an embodiment of the method according to the invention.

In FIG. 1, part 4 illustrates the pump well, the surface level of the contents of which is controlled by an immersed valve 3 by throttling the suction inlet of the pump 5. The flow meter 1 and the densimeter 2 are very sensitive to pressure impulses, which are easily produced in pressure-side control by throttling.

Figure 2:
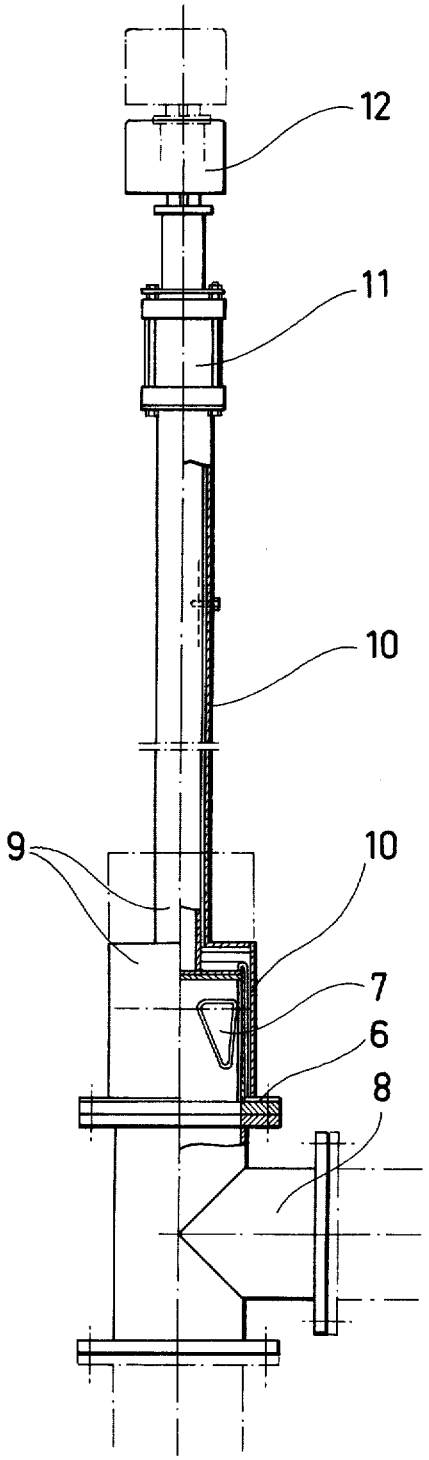
FIG. 2 shows an immersed valve meant for throttling the suction side.

The actual valve part of the immersed valve shown in FIG. 2 consists of a collar gasket 6, an outer pipe 9, and an inner pipe 10. The outer pipe 9 and the inner pipe 10 can be moved in relation to each other by means of a working cylinder 11. Device 12 positions the working cylinder 11. When the outer pipe is in its upper position, which is indicated in the figure by a dotted-broken line, the valve is fully open. At this time sludge flows through the inlets 7 into the supporting pipe 8 and from there into the pump 5. The collar gasket is of such form that when the lower end of the outer pipe 9 presses against it the valve is fully closed and tight.

The shape, size, and number of the flow inlets 7 of the inner pipe 10 are determined by the requirements set by the quality and control of the flowing liquid. The flow inlets 7 are placed so in relation to each other that the radial forces produced by the effect of the flow and the suction refute each other, i.e., the outer pipe 9 must be suspended freely, supported by its driving device 11.

Figure 3:
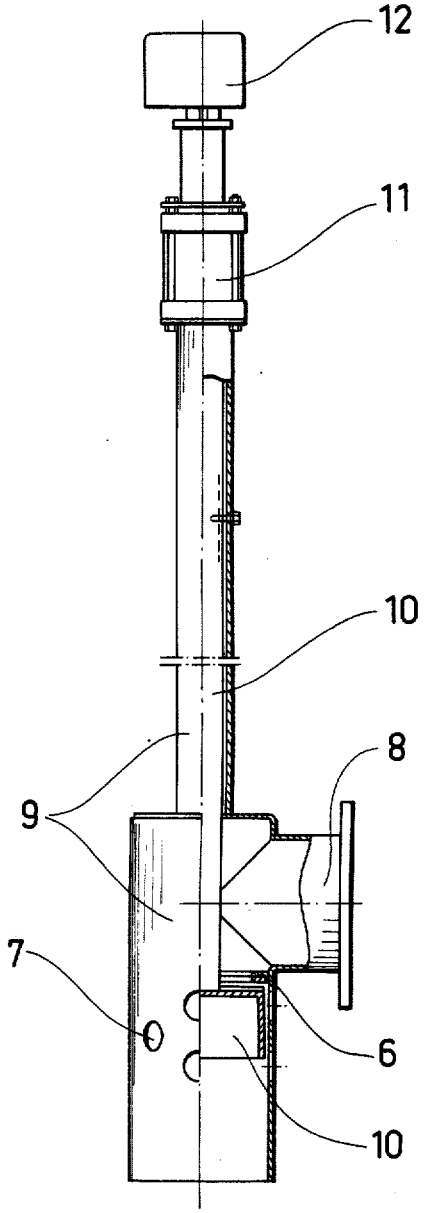
FIGS. 3 and 4 show other embodiments of the immersed valve.
Figure 4:
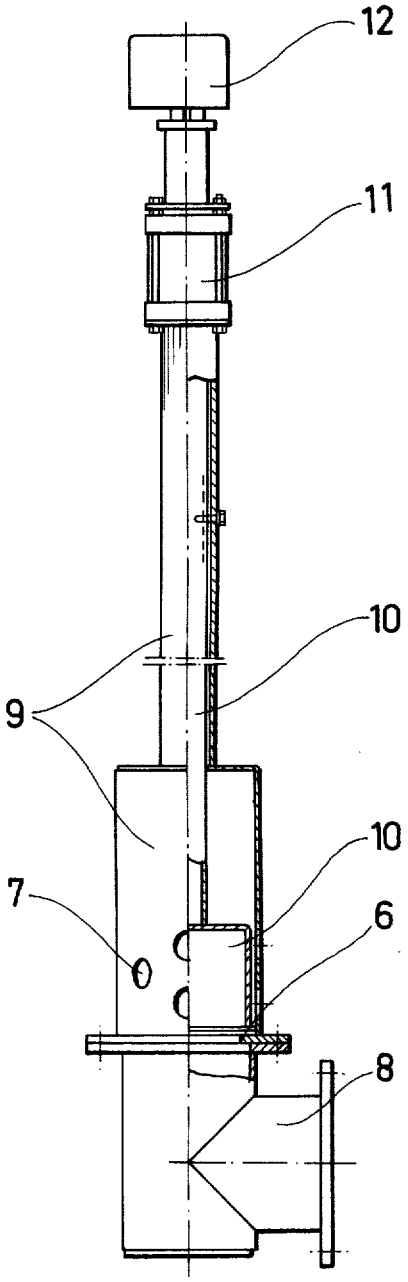

In the immersed valve shown in FIG. 2, the inner pipe 10 has been attached to the supporting pipe 8, and the outer pipe 9 can thus be moved. In the embodiments according to FIGS. 3 and 4, on the contrary, the outer pipe 9 has been secured to the supporting pipe 8 and the inner pipe 10 can be moved. In this case the flow inlets 7 are in the outer pipe 9.

The outer pipe 9 and the inner pipe 10 need not necessarily be capable of being moved in the longitudinal direction as shown in the figures, but alternatively they can be capable of being turned in relation to each other around their longitudinal axis. In this case the flow inlets 7 are both in the outer pipe 9 and the inner pipe 10.

The immersed valve is attached to a block fitted either to the wall or to the bottom of the sludge chamber so that the valve part is either entirely or at least partly below liquid level. The supporting pipe 8 must be sturdy enough to bear the entire weight of the valve.

The driving device 11, 12 need not be above liquid level, but this is the most advantageous embodiment.

The immersed valve used can be provided with a pneumatic, hydraulic, electric, or manual driving device.

The operation of the method according to the invention was investigated in two different trials. In one of the performed trials the aim was to observe the operation of a pump according to the embodiment illustrated in FIG. 1 when using for liquid level control:

return from pressure pipe to pump well
throttling of suction inlet
no liquid level control The following quantities were measured:
power of motor driving the pump
sludge rate
density of sludge liquid level in well The sludge density was approximately constant during the trial, 2.25 kg/dm³. At the beginning of the control-by-return experiment, the sludge density varied slightly according to the return rate, but later the variations evened out. In the trial run without liquid level control the sludge density slightly vacillated in the rhythm of the pumpage vacillation.

The power meter indicated that the intake of energy was the most even during the suction-inlet throttling control experiment. During the trial run without liquid level control the sludge rate varied rather much and it could be seen in the energy intake of the pump as well.

In terms of liquid level control in the well, the suction-side throttling and the return from the pressure pipe are approximately equal. In both trials, the liquid level of the well varied about 10 cm.

The pressure on the pressure side was considerably more even in control by suction-side throttling than in control by return. Even small changes in the return valve could be observed as being strong in the pressure of the pressure side, while a change in the valve on the suction side did not have much effect on the pressure of the pressure side. Without liquid level control the well was almost empty, the flow rate varied greatly, and the pressure of the pressure side varied according to the flow within 0–1 kp/cm².

The required pumping energy/sludge rate was

| | |
|---|---|
| in control by return | 0.216 kWh/m³ |
| in control by suction-side throttling | 0.174 " |
| without liquid level control | 0.186 " |

According to the obtained results, control by return saves about 23 % more energy than suction-side throttling. Even such a small difference was due to the fact that during the trial the pump worked close to maximum efficiency, in which case the requisite return flow was small. When comparing control by throttling and pumping without liquid level control, the former is 6.5 % more advantageous.

In the second trial the operation of another pump was observed when using for the liquid level control of the pump well:

suction-inlet throttling
pressure-pipe throttling
no liquid level control in well The same quantities were measured in this trial as in the previous one.

The control valve of the pressure side was a 6 inch tube valve and the valve of the suction side was an immersed valve.

The rate of sludge flowing into the pump well during the trial varied greatly. The intake of energy also vacillated according to the sludge rate. Suction-side control to some extent calmed the situation, for the variations in the flow rate and the sludge density were the slowest during the suction-inlet control.

The following results were obtained:

Suction-inlet control

| | |
|---|---|
| average variation of flow | 30 m³ |
| average variation of power | 5.4 kW |
| average variation of sludge density | 0.028 kg/dm³ |
| energy consumption/sludge amount | 0.114 kWh/m³ |

Pressure pipe control

| | |
|---|---|
| average variation of flow | 90 m³ |
| average variation of power | 11 kW |
| average variation of sludge density | 0.053 kg/dm³ |
| energy consumption/sludge amount | 0.129 kWh/m³ |

Without liquid level control

| | |
|---|---|
| average variation of flow | 130 m³ |
| average variation of power | 12.7 kW |
| average variation of sludge density | 0.053 kg/dm³ |
| energy consumption/sludge amount | 0.113 kWh/m³ |

The liquid level variation in the well was about 7 cm during suction-side control. During pressure-pipe control the liquid level variation was slightly greater because the well tended to become empty. The lesser vacillation during the suction control trial is due to the fact that the immersed valve works very fast since the structure of the valve allows the use of a small-diameter (θ 100 mm) cylinder. A tube valve has a cylinder with a diameter of 150 mm, and even this cannot quite close the pressure pipe by throttling and its performance is very slow. As a whole the poorer operation of pressure pipe control was due to the slow performance of the pressure valve, because the sludge level variations in the pump well were rapid. The performance of a control valve should also be very rapid so that is could correct the changes in time. The well liquid level remained about 1 m above the suction inlet of the pump when the suction-side valve was about 20 % open. But the pressure valve had to be almost closed before the level in the well began to rise. The collar tube was then subjected to a very high strain.

Energy consumption per sludge amount was the smallest when pumping without sludge level control and the greatest in pressure-pipe control. The results are not absolutely precise, but they are comparable since the measuring conditions were the same in each trial and the measuring errors assumably also remained constant. Thus, the result according to which sludge level control by pressure-pipe throttling consumes about 13 % more energy per sludge amount than suction-side throttling, can be considered quite reliable.

When, in addition, a special-structured valve in which the forces caused by the flow are in a balance is used for throttling the suction inlet, a small-dimensioned cylinder can be used and the obtained control is rapid and precise.

The control method according to the invention has been in trial use in our concentrate plant where the solid content of the sludge varies between -70 % so that it is 70 % at the pump after grinding and 5 % in the sludge to be pumped to the waste area.

It has also been noted in this case that the life of the pump parts has increased. For example, the life of the runner of a pump increased 500–1140 h in spite of an increased risk of cavitation.

What is claimed is:

1. In combination, a sludge reservoir, a pump for pumping sludge from said reservoir, a channel leading from said reservoir to a suction side of said pump, and a valve submerged during operation in sludge in said reservoir, said valve having a pair of coaxially related members in relatively slidable interfitted relationship with each other, one of said members having an apertured wall for sliding against the other of said members, and means for effecting relative sliding movement between said members for controlling sludge flow through one or more apertures of said apertured wall, one of said members being connected to said channel.

2. The combination of claim 1, further comprising a collar gasket fixed to one of said members and adapted to form a sludge-tight seal with an edge of the other of said members when the apertures of said apertured wall are totally closed.

3. The combination of claim 1 in which an inner one of said members has an apertured end fixedly attached to said channel and the means for effecting said relative sliding movement is fixedly attached to an opposite end of said inner member.

4. The combination of claim 1 wherein said one or more apertures are triangular.

* * * * *

UNITED STATES PATENT OFFICE

CERTIFICATE OF CORRECTION

PATENT NO. : 3937591

DATED : February 10, 1976

INVENTOR(S) : Vilho Viljo Jantunen

It is certified that error appears in the above-identified patent and that said Letters Patent are hereby corrected as shown below:

Col. 4 Line 28 - before "could" the word "is" should be -- it --

Col. 4 Line 52 - the line should read:

-- solid content of the sludge varies between 5-70% so that --

Signed and Sealed this

*twenty-fifth* Day of *May 1976*

[SEAL]

*Attest:*

RUTH C. MASON
*Attesting Officer*

C. MARSHALL DANN
*Commissioner of Patents and Trademarks*